United States Patent [19]

Davis

[11] Patent Number: 4,461,423

[45] Date of Patent: Jul. 24, 1984

[54] SPRINKLER SHIELD

[75] Inventor: J. C. Davis, 8724 Dublin Dr., Bakersfield, Calif. 93307

[73] Assignees: J. C. Davis; Charlotte Davis; Larry V. Anderson; Autrey Anderson, all of Bakersfield, Calif.

[21] Appl. No.: 276,185

[22] Filed: Jun. 22, 1981

[51] Int. Cl.[3] ..... B05B 1/26

[52] U.S. Cl. ..... 239/231; 239/505; 248/296; 248/219.1

[58] Field of Search ..... 239/288–288.5, 239/231, 505; 248/296, 219.1, 302

[56] References Cited

U.S. PATENT DOCUMENTS

| | | | |
|---|---|---|---|
| 1,806,100 | 5/1931 | Thompson | 239/231 |
| 2,530,779 | 11/1950 | Owbridge | 239/231 |
| 2,999,644 | 9/1961 | Nobinger | 239/231 X |
| 3,009,652 | 11/1961 | McKay | 239/288.3 X |
| 3,703,993 | 11/1972 | Schreiner | 239/231 |

*Primary Examiner*—John J. Love

*Attorney, Agent, or Firm*—Vergil L. Gerard

[57] ABSTRACT

Disclosed is a shield for sprinklers, which can be quickly attached and detached from a sprinkler standpipe. The shield has a semi-circular deflector mounted at the top of a support rod. A hook is formed in the bottom of the support rod to engage the standpipe. The hook is disposed in a plane substantially horizontal to the support rod, has a slightly helical configuration, and opens in laterally with respect to said rod. Midway of said rod a brace projects from said rod substantially normal thereto and has a standpipe engaging fork in its outer end. The hook readily engages the standpipe when the support rod is parallel to the standpipe and clamps to it when the upper end of the support rod is drawn away from the standpipe to engage the brace with the standpipe.

12 Claims, 5 Drawing Figures

SPRINKLER SHIELD

BACKGROUND OF INVENTION

This invention relates generally to fluid handling equipment and more particularly to devices for shielding the spray from sprinklers used in irrigation.

For some time it has been relatively common to use sprinkler irrigation in agriculture as well as for household gardens. One popular form of these sprinkler systems uses standpipes or risers which rise vertically from a main supply pipe either permanently placed underground or novably located on the ground surface. Sprinklers are mounted in the top of these standpipes which deliver a spray of water to the surrounding area. Some of the sprinklers have a facility for effectively limiting their area of coverage to less than the entire circular area around them, others do not. Since such sprinklers are often located near roadways, driveways, walkways, buildings or other structures or areas in which it is not desirable to have water sprayed, devices for shielding or deflecting spray from a certain segment of the sprinklers' normal area of coverage have been developed.

The following United States patents have been located which illustrate generally the state of the prior art. These are all of the patents or publications pertinent to the prior art of which I am presently aware.

| Date Issued | Patentee | U.S. Pat. No. |
|---|---|---|
| May 19, 1931 | W. Van E. Thompson | 1,806,100 |
| Nov. 21, 1950 | H. H. Owbridge | 2,530,779 |
| Oct. 13, 1942 | A. Johnson | 2,298,765 |
| Nov. 28, 1972 | James W. Schreiner | 3,703,993 |
| Nov. 21, 1961 | R. McKay | 3,009,652 |

Of this prior art, the devices disclosed in patents to McKay and Thompson are best adapted to fill the need to which my invention is directed. That is, a shield which can be adjustably mounted on a sprinkler standpipe to provide a deflector which prevents spray from the sprinkler from entering a segment of the sprinklers' normal area of coverage. Each of these devices has substantial disadvantages which my invention overcomes.

Particularly in agricultural use, shields of this type must be fairly substantial in size and weight because the sprinklers are large and deliver a powerful spray. Also, in agricultural use the standpipes are larger in diameter and higher than for garden use. In addition, the supply pipes are usually laid above ground and moved from place to place as irrigation is desired. Therefore, the shields must be attached and detached from the standpipes to suit the particular circumstances in the area where the irrigation is being carried out. Although my invention will work well in garden sprinkler systems, it is most useful in the larger, more powerful, movable sprinkler systems used in agriculture.

The shield shown in the McKay patent is typical of those presently in use in agriculture. It is obviously designed for permanent installation on the standpipe, but even if the attachment clamps were "C" shaped so they could be removed from the standpipe without first removing the sprinkler, considerable effort is required to attach, detach and adjust the device. Worse of all, the adjustments and attachments are all made with set screws and around water these screws readily rust anc become unworkable.

The device shown by McKay appears simple to attach but is not capable of forming a secure enough attachment to support the larger shields required for agricultural usage, for if the bottom clamp of Thompson's were made rugged enough to support a large, heavy shield it would be difficult, if not impossible, to release it from the standpipe by hand.

Accordingly, a need still exists for a sprinkler shield which can be made rugged enough for agricultural use and is still readily attachable and detachable by hand and without the use of any tools.

OBJECTS OF INVENTION

It is, therefore, a major object of my invention to provide a rugged sprinkler shield which can be readily attached and detached to a sprinkler standpipe by hand.

It is also an important object of my invention to provide a sprinkler shield which is substantially indestructable in normal use and storage.

Still another object of my invention is to provide a sprinkler shield of the type described which is simple and inexpensive to manufacture and substantially maintenance free.

Yet a further object of my invention is to provide a sprinkler shield of the type described which can be readily adjusted in height and radial position on the standpipe, and made for a great variety of applications.

These and other objects and advantages of my invention will be more readily apparent from the following detailed description of a preferred embodiment and the following drawings in which.

DETAILED DESCRIPTION OF PARTS

Figure 1:
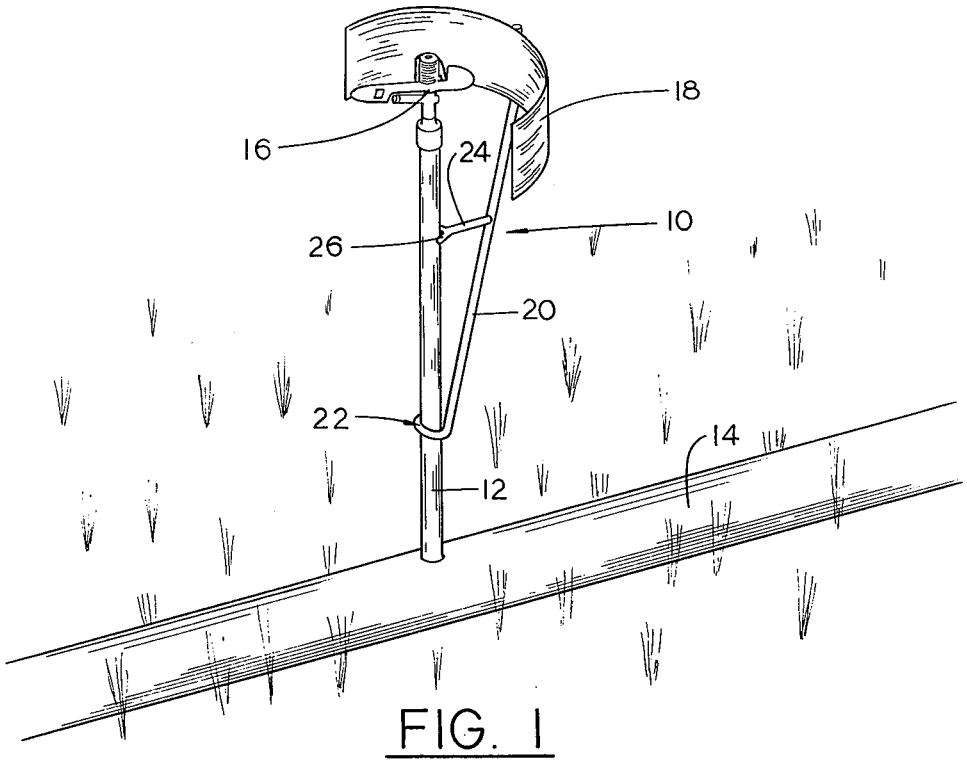
FIG. 1 is a perspective view of a preferred embodiment of my invention mounted on the sprinkler standpipe of an above ground movable agricultural sprinkler system.
Figure 2:
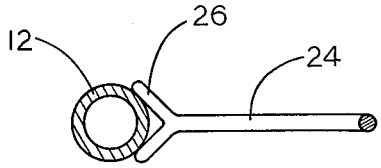
FIG. 2 is a sectional plan view showing the configuration of the standpipe engaging fork on the outer end of the brace of the preferred embodiment.
Figure 3:
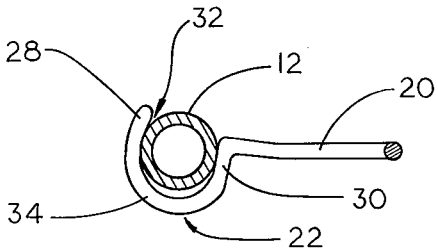
FIG. 3 is a sectional plan view showing the configuration and attachment of the standpipe engaging hook on the lower end of the support rod of the preferred embodiment.

Referring now to the drawings and particularly to FIGS. 1–3 thereof, the numeral 10 designates a preferred embodiment of my invention mounted on a standpipe 12 rising from a movable supply pipe 14 with a sprinkler 16 on the upper end of the standpipe.

My sprinkler shield 10 has a semi-circular deflector 18 mounted on the upper end of a support rod 20. Formed integral with its lower end, the support rod 20 has an attachment hook 22 which engages the standpipe 12. Approximately midway of the length of the support rod 20 a brace 24 extends outwardly from the support rod, substantially normal thereto. At its outermost end the brace 24 has a standpipe engaging fork 26.

As best shown in FIG. 2 the fork 24 spreads a sufficient distance to hold the brace 24 from lateral movement with respect to the standpipe 12 when the fork is engaged with the stantpipe.

Figure 4:
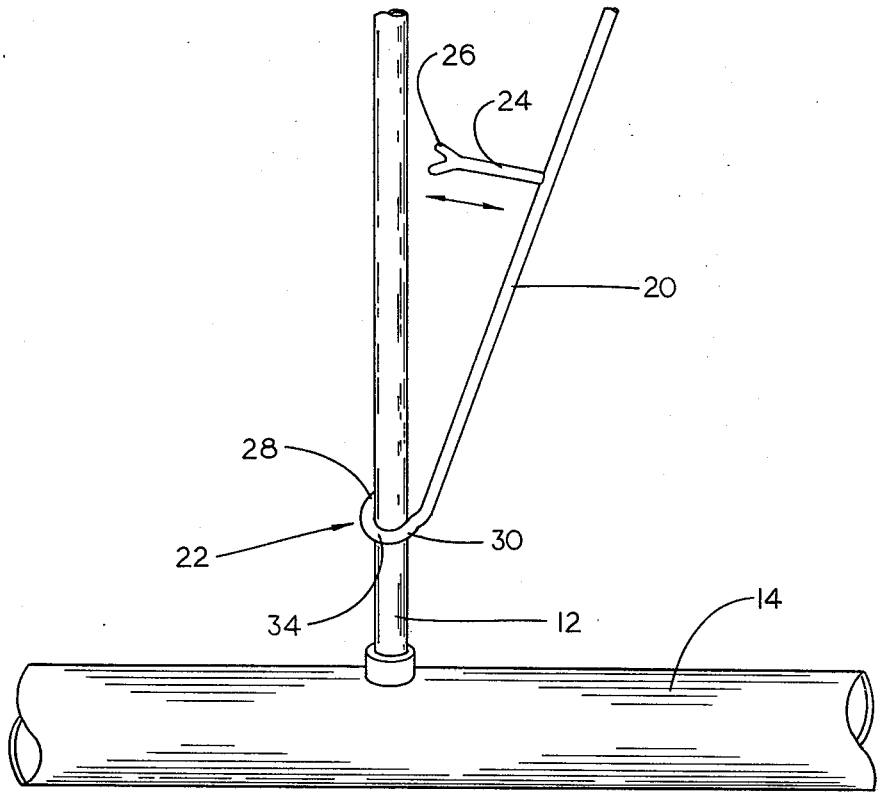
FIG. 4 is an enlarged side elevational view of my preferred embodiment showing the hook engaged with the standpipe and the support rod resiliently sprung away from the standpipe at its upper end to bring the brace into engagement with the standpipe.
Figure 5:
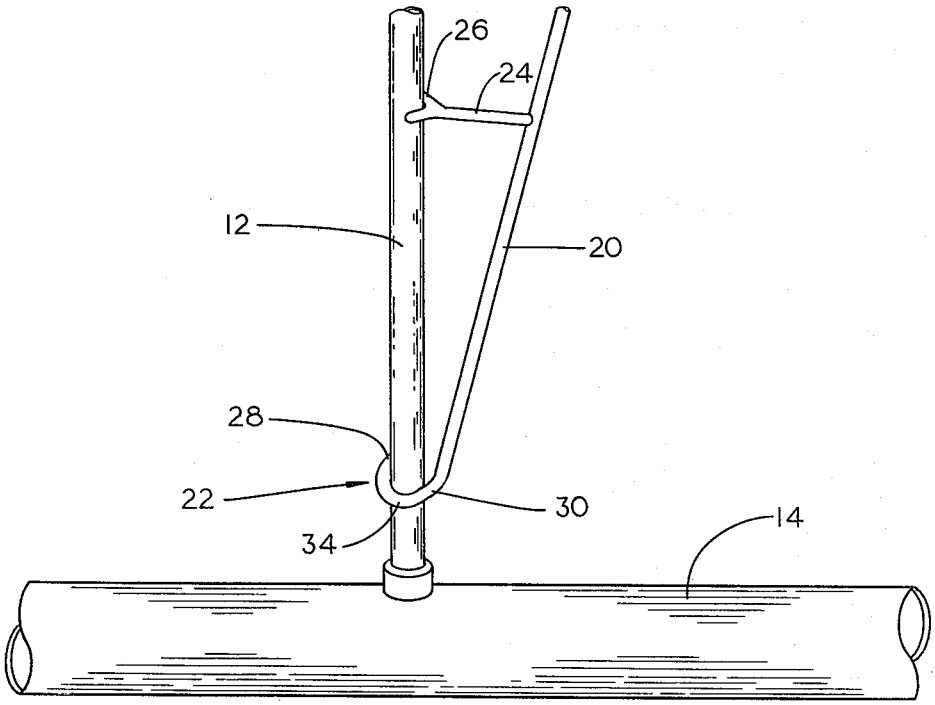
FIG. 5 is an enlarged side elevational view of my preferred embodiment showing the shield in final attachment position on the standpipe.

In FIGS. 4 and 5, the means of attaching and detaching my sprinkler shield to a standpipe are illustrated. Attachment is accomplished by engaging the hook 22 with the standpipe when the support rod 20 is adjacent the standpipe and generally parallel thereto. The top portion of the support rod is then moved away from the standpipe which draws the tip 28 and the base 30 of the hook 22 into engagement with the standpipe on opposite sides.

The configuration of the hook 22 is such that mouth 32 is sufficiently large to readily accept the standpipe when the hook is disposed in a substantially horizontal plane. The hook 22 extends outwardly from the bottom of the support rod 20 substantially normal to the lower end of the rod, and the mouth 32 of the hook opens in a lateral direction with respect to the shield, so that the mouth is positioned to snuggly move about the standpipe 12 from the side when the support rod 20 is adjacent to and generally parallel with the standpipe. Also, the hook body 34 is somewhat helical in configuration so that when the hook is generally horizontal the tip 28 is positioned slightly above the base 30.

Due to this unique configuration of the hook 22 the tip 28 engages its side of the standpipe 12 at a point slightly above the point where the base 30 engages the opposite side of the standpipe, as the top of the support rod 20 is drawn away from the top of the standpipe 12, as aforesaid. The standpipe 12 is, therefore, gripped between the hook tip 28 and hook base 30 as if between two jaws of a pair of scissors or pliers.

Once the hook tip 28 and hook base 30 have contacted opposite sides, the top of the support rod 20 can only be moved further away from the top of the standpipe by resiliently springing the support rod. The configuration of the hook 22 is such that contact occurs before the top of the support rod 20 can be moved away from the top of the standpipe 12 a sufficient distance to permit the fork 26 on the outer end of the brace 24 to be placed in engaging contact with the standpipe. Therefore, in order to complete attachment of my sprinkler shield 10 to the standpipe 12, the upper end of the support rod 20 must be resiliently sprung away from the top of the standpipe 12 until the brace 24 is spaced from the standpipe when aligned to engage it (see FIG. 4), and then released to permit the fork 26 to be resiliently urged into engagement with the standpipe (see FIG. 5). In this condition my sprinkler shield 10 is firmly attached to the standpipe 12 with the hook tip 28 and base 30 gripping the lower portion of the pipe and the fork 26 engaging the upper portion of the pipe all under resilient urging by reason of the distortion of the support rod.

Detachment of my sprinkler shield 10 is accomplished by reversing the attachment maneuver. The top of the support rod 20 is resiliently sprung further away from the top of the standpipe 12 to allow the fork 26 on the end of brace 24 to clear the standpipe and be manuevered out of engaging alignment with it, and then releasing the top of the support rod and moving it back into a substantial adjacent and parallel position with respect to the standpipe. With the support rod 20 in this position the hook tip 28 and base 30 are rotated back into closer to horizontal alignment and the hook mouth 32 is of sufficient width to permit easy withdrawal of the hook 22 from the standpipe 12.

The deflector 18 is shown substantially semi-circular in this embodiment but it should be understood that it could be a lesser or greater arc, have a different radius or be planar or of other configuration, as may be desired to achieve its water deflecting purpose.

By proper placement during attachment, my sprinkler shield 10 can be positioned higher or lower on the standpipe 12 or at different radial positions.

From this detailed description of the parts and operation of my sprinkler shield it should be understood it is simple to attach and detach, of rugged construction and inexpensive to make, and yet provides a secure mounting without the use of tools even when it is sufficiently large and heavy for agricultural use. Particularly, it should be understood that my sprinkler shield will provide the advantages and achieve the objectives heretofore attributed to it.

I claim:

1. An improved sprinkler shield comprising:

an elongated resiliently bendable support rod having an upper end and a lower end;

a deflector mounted adjacent the upper end of said support rod and disposed to deflect fluid sprayed thereon;

jaw means mounted adjacent the lower end of said support rod and disposed to receive and release a sprinkler standpipe therein substantially laterally with respect to the axis of said standpipe when said support rod is disposed in a first angular relationship with said standpipe and to clampingly engage said standpipe when said support rod is disposed in a second angular relationship with respect to said standpipe; and releasable positioning means mounted on said support rod intermediate the ends thereof and disposed to engage said standpipe substantially laterally with respect to the axis of said standpipe and hold said support rod in said second angular relationship with said standpipe with said jaw means clamplingly engaging said standpipe said support rod being resiliently bent about said jaw means by engaging said positioning means on said standpipe.

2. An improved sprinkler shield as described in claim 1, in which:

said jaw means include a generally helical hook having a proximal end interconnected with the lower end of said rod, and a distal end spaced from the lower end of said rod a distance sufficient to pass a sprinkler standpipe, when said jaw means is applied to said standpipe in said first angular position.

3. An improved sprinkler shield as described in claim 1, in which:

said jaw means include a generally helical hook having a proximal end interconnected with the lower end of said support rod and a distal end spaced from said proximal end a distance sufficient to pass a sprinkler standpipe when said jaw means are applied to said standpipe with said rod in said first angular position with respect to said standpipe, and being so disposed with respect to said proximal end that said standpipe is clamped between said proximal end and said distal end of said hook when said rod is moved to said second angular position with respect to said standpipe.

4. An improved sprinkler shield as described in claim 1, in which:

said jaw means are so disposed that said second angular position is attained by resiliently deflecting said support rod, whereby when said positioning means are disposed to hold said support rod in said second position said jaw means are resiliently urged into clamping engagement with said standpipe by means of the bendable resilience of said support rod.

5. An improved sprinkler shield as described in claim 3, in which:

said positioning means and said jaw means are so interrelated that said jaw means engage said standpipe before said second angular position is attained and resilient bending of said support rod is required to engage said positioning means with said standpipe whereby said jaw means are resiliently urged in said clamping engagement of said standpipe by the resilient bending of said support rod.

6. An improved sprinkler shield as described in claim 1, in which:

said first angular position is substantially vertical and parallel with said standpipe and said second angular position is more acute and oblique from said standpipe; and said releasable positioning means include a rigid spacing member with a proximal end interconnected with said support rod and a distal end laterally extended from said support rod and having a releasable standpipe engaging clamp thereon, said spacing member being releasably disposable between said standpipe and said support rod to resiliently bend said support rod away from said standpipe.

7. An improved sprinkler shield as described in claim 1, in which:

said first angular position is substantially acute and oblique with respect to said standpipe and said second angular position is more vertical and parallel with respect to said standpipe; and said releasable positioning means include an elongated connecting member having a proximal end interconnected with said support rod and a distal end extended therefrom and having clamp means releasably engageable with said standpipe, said connecting member being releasably interconnectable between said standpipe and said support rod to resiliently deflect said support rod toward said standpipe.

8. An improved sprinkler shield as described in claim 6, in which:

said jaw means includes a helically shaped hook having a proximal end interconnected with the lower end of said support rod and a distal end spaced outwardly and downwardly therefrom a distance sufficient to pass a sprinkler standpipe when said jaw means are applied to said standpipe with said support rod in said first angular position with respect to said standpipe, and being so disposed with respect to said proximal end as to engage by scissor action said standpipe between said distal end and said proximal end when the upper end of said support rod is resiliently urged away from said standpipe into said second angular position with respect to said standpipe by engagement of said distal end of said rigid spacing member with said standpipe.

9. An improved sprinkler shield as described in claim 7, in which:

said jaw means includes a helically shaped hook having a proximal end interconnected with the lower end of said support rod and a distal end spaced outwardly and upwardly therefrom a distance sufficient to pass a sprinkler standpipe when said jaw means are applied to said standpipe with said support rod in said first angular position with respect to said standpipe, and being so disposed with respect to said proximal end as to engage by scissor action said standpipe between said distal end and said proximal end when the upper end of said support rod is resiliently urged toward said standpipe into said second angular position with respect to said standpipe by engagement of said distal end of said connecting member with said standpipe.

10. In a sprinkler shield having an elongated support rod with a fluid deflector mounted on its upper end, and clamping means for releasably attaching said sprinkler shield to a sprinkler standpipe, an improvement comprising;

forming said support rod of resiliently bendable material;

forming a substantially helical bend in the lower end of said support rod, said helical bend having a proximal end adjacent the lower end of said support rod and a distal end helically extended therefrom substantially one hundred eighty degrees and spaced therefrom a distance sufficient to pass said sprinkler standpipe therethrough; and a connecting member mounted intermediate the ends of said support rod and disposed for interconnection between said sprinkler standpipe, said connecting member being disposed to angularly move said support rod with respect to the longitudinal axis of said sprinkler standpipe to tilt said helical bend into clamping engagement with said standpipe and resiliently bend said support rod when said connecting member is interconnected between said standpipe and said support rod.

11. An improvement in a sprinkler shield as described in claim 10, in which:

said distal end of said helical bend is downwardly disposed from said proximal end; and said connecting member is a rigid strut affixed to said support rod and extending laterally outward therefrom and has a standpipe engaging foot on its outer end.

12. An improvement in a sprinkler shield as described in claim 10, in which:

said distal end of said helical bend is upwardly disposed from said proximal end; and said connecting member is a flexible connector attached to said support rod and extending laterally outward therefrom and has a standpipe engaging hook on its outer end.

* * * * *